US006832584B2

(12) United States Patent
Murata et al.

(10) Patent No.: US 6,832,584 B2
(45) Date of Patent: Dec. 21, 2004

(54) VALVE SYSTEM FOR INTERNAL COMBUSTION ENGINE

(75) Inventors: Shinichi Murata, Okazaki (JP); Toshihiko Oka, Anjyo (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/443,887

(22) Filed: May 23, 2003

(65) Prior Publication Data

US 2003/0221645 A1 Dec. 4, 2003

(30) Foreign Application Priority Data

May 24, 2002 (JP) ..... 2002-151361

(51) Int. Cl.[7] ..... F01L 1/34
(52) U.S. Cl. ..... 123/90.16; 123/90.15
(58) Field of Search ..... 123/90.15, 90.16, 123/90.31

(56) References Cited

U.S. PATENT DOCUMENTS

| | | | | |
|---|---|---|---|---|
| 4,501,460 A | | 2/1985 | Sisler | |
| 5,085,182 A | * | 2/1992 | Nakamura et al. | 123/90.16 |
| 5,495,832 A | * | 3/1996 | Fujii et al. | 123/90.16 |
| 5,645,434 A | | 7/1997 | Leung | |
| 5,651,336 A | * | 7/1997 | Rygiel et al. | 123/90.16 |
| 5,838,548 A | | 11/1998 | Matz et al. | |
| 6,059,614 A | | 5/2000 | Shelby et al. | |
| D426,612 S | | 6/2000 | Primeau, IV | |
| 6,137,686 A | | 10/2000 | Saye | |
| 6,141,221 A | | 10/2000 | Tong et al. | |
| 6,304,188 B1 | | 10/2001 | Subak et al. | |
| 6,462,953 B2 | | 10/2002 | Tong et al. | |

FOREIGN PATENT DOCUMENTS

JP 2001-41017 A 2/2001

* cited by examiner

*Primary Examiner*—Thomas Denion
*Assistant Examiner*—Zelem Eshete
(74) *Attorney, Agent, or Firm*—Birch, Stewart, Kolasch & Birch, LLP

(57) ABSTRACT

A valve system for an internal combustion engine has first rocker arms supported by a rocker shaft such that they rock when driven by first cams; a second rocker arm supported by the rocker shaft such that it rocks when driven by a second cam, the second rocker arm being disposed adjacent to the first rocker arms; a connection switching mechanism that switches the first rocker arms between a state of being connected to the second rocker arm and a state of being disconnected from the second rocker arm; a forcing member that forces the second rocker arm toward the second cam while the second rocker arm is rocking; a supporting member rotatably supported by a support shaft provided on a cylinder head to support the forcing member; and a locking structure that inhibits the supporting member from rotating about the support shaft.

11 Claims, 6 Drawing Sheets

VALVE SYSTEM FOR INTERNAL COMBUSTION ENGINE

The application incorporates by reference the subject matter of Application No. 2002-151361 filed in Japan on May 25, 2002, on which a priority claim is based under 35 U.S.C. § 119(a).

BACKGROUND OF THE INVENTION

1. Field of the Invention

The present invention relates to a valve system for an internal combustion engine capable of opening and closing intake valves and exhaust valves of the internal combustion engine at different timings.

2. Description of the Related Art

In recent years, a valve system (also referred to as "variable valve system"), which is capable of changing operating characteristics (such as opening/closing timing, opening time, and so forth) of intake valves and exhaust valves (hereinafter generically referred to as "engine valves" or "valves") provided in a reciprocating internal combustion engine (hereinafter referred to as "engine") to the optimum characteristics according to engine load and speed, have been developed and put into practical use.

As an example of a mechanism for changing operating characteristics as described above, a variable valve system is disclosed in Japanese Laid-Open Patent Publication (Kokai) No. 2001-41017. This variable valve system is comprised of a connection mechanism constructed such that a low-speed rocker arm is provided with a hydraulic piston, and an engagement projection formed in a high-speed rocker arm is selectively engaged with the piston such that the valve timing can be switched between a low speed and a high speed. Further, this variable valve system is comprised of return springs that inhibit the rocker arms from getting away from respective corresponding cams.

It is therefore an object of the present invention to provide a valve system for an internal combustion engine, which has a connection mechanism pressed against a cam by force other than return springs of engine valves.

SUMMARY OF THE INVENTION

To attain the above object, the present invention provides a valve system for an internal combustion engine, comprising: a first rocker arm supported by a first rocker shaft such that it rocks when driven by a first cam, and having an end thereof connected to one of an intake valve and an exhaust valve; a second rocker arm supported by the first rocker shaft such that the second rocker arm rocks when driven by a second cam having a different cam profile from that of the first cam, the second rocker arm being disposed adjacent to the first rocker arm; and a connection switching mechanism that switches the state of the first rocker arm between a state in which the first rocker arm is connected to the second rocker arm and a state in which the first rocker arm is disconnected from the second rocker arm. As a result, when the connection switching mechanism is brought into the state in which the first rocker arm and the second rocker arm are connected, the first rocker arm rocks integrally with the second rocker arm to open and close one of the intake valve and the exhaust valve according to the cam profile of the second cam, and when the connection switching mechanism is brought into the state in which the first rocker arm is disconnected from the second rocker arm, the first rocker arm rocks without being affected by the movement of the second rocker arm to open and close one of the intake valve and the exhaust valve according to the cam profile of the first cam.

Further, the valve system for the internal combustion engine comprises a forcing member that forces the second rocker arm toward the second cam while the second rocker arm is rocking so as to follow the rotation of the second cam. The second rocker arm can rock according to the cam profile of the second cam while being abutted against the second cam in a reliable manner. A support member that supports the forcing member is rotatably supported by a support shaft provided on a cylinder head, and is configured such that a locking structure inhibits the forcing member from rotating about the support shaft, so that the forcing member can support the forcing member in a reliable manner.

BRIEF DESCRIPTION OF THE DRAWINGS

The nature of this invention, as well as other objects and advantages thereof, will be explained in the following with reference to the accompanying drawings, in which like reference character designate the same or similar parts throughout the figures and wherein;

FIG. 6 is a set of sectional views schematically showing a connection switching mechanism in the valve system for the internal combustion engine, wherein

FIG. 7 is a graph showing valve characteristics of the valve system for the internal combustion engine, wherein

DETAILED DESCRIPTION OF THE PREFERRED EMBODIMENTS

The present invention will now be described in detail with reference to the accompanying drawings showing preferred embodiments thereof.

First, a description will be given of a first embodiment.

A valve system 30 according to the present embodiment is has a structure that supports an arm spring 43 serving as a forcing member which urges force against a rocker arm (second rocker arm) 35.

Figure 1:
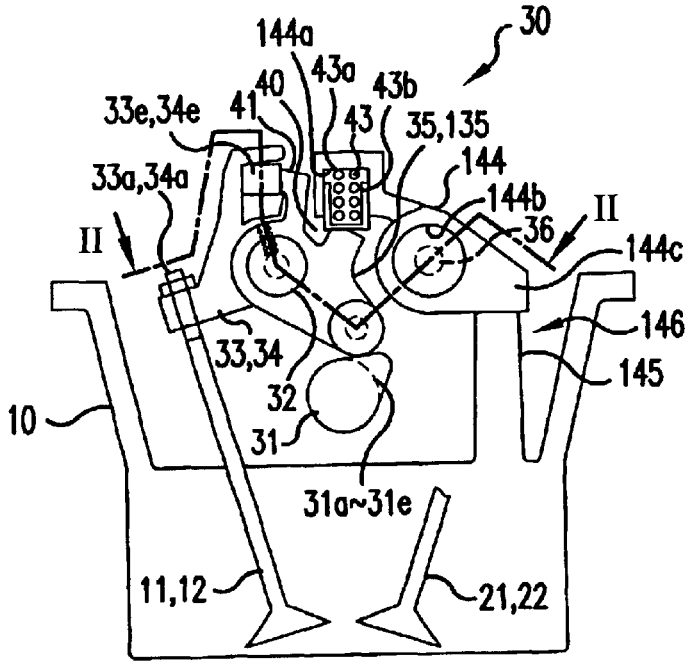
FIG. 1 is a side view schematically showing the inside of a cylinder head in a valve system for an internal combustion engine according to a first embodiment of the present invention.
Figure 2:
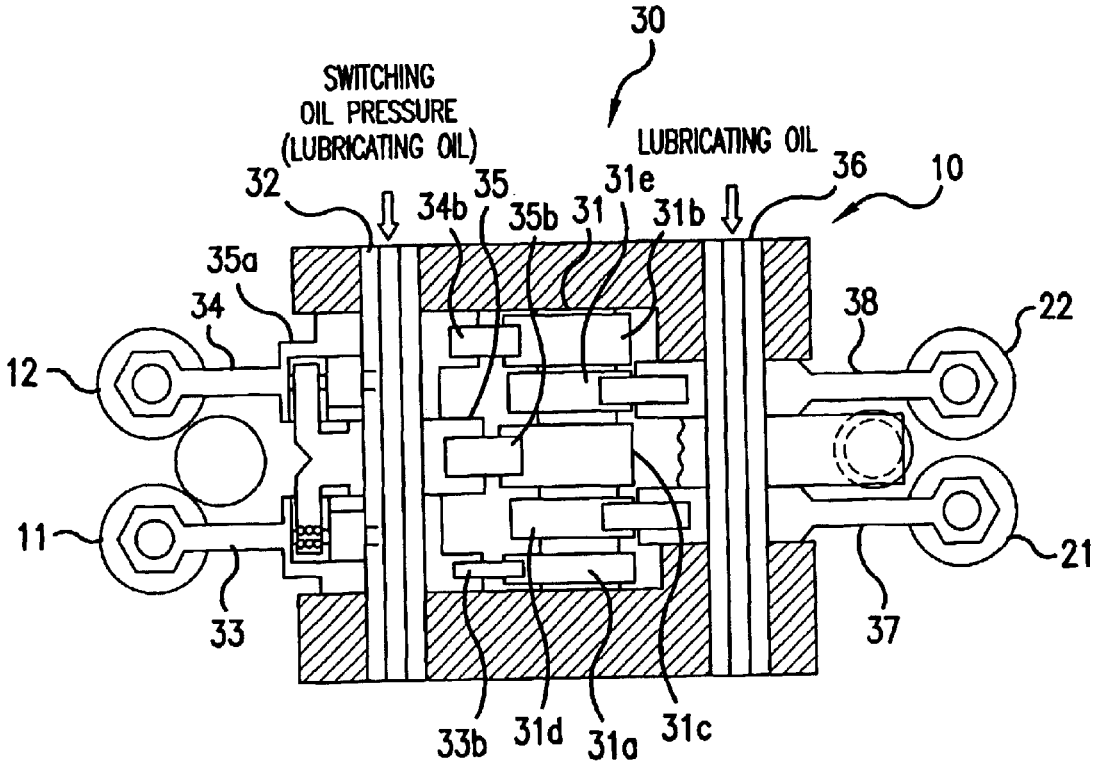
FIG. 2 is a sectional view (sectional view taken along the arrow II—II in FIG. 1) schematically showing the inside of the cylinder head in the valve system of the internal combustion engine according to the first embodiment.

Specifically, as shown in FIGS. 1 and 2, each cylinder head 10 in the upper part of each cylinder of an engine is provided with two intake vales 11 and 12 and two exhaust valves 21 and 22. The valve system 30 drives the intake valves 11 and 12 and the exhaust valves 21 and 22.

The valve system 30 is comprised of an intake valve driving system that drives the intake valves 11 and 12 and an exhaust valve driving system that drives the exhaust valves 21 and 22.

The intake valve driving system is comprised of a cam shaft 31, cams 31*a* to 31*c* installed fixedly on the cam shaft 31, an intake rocker shaft (first rocker shaft) 32, and rocker arms 33 to 35 which are rotatably supported on the rocker shaft 32 so that it may be rocked by the cams 31*a* to 31*c*.

The exhaust valve driving system is comprised of the cam shaft 31 shared with the intake valve driving system, cams 31*d* and 31*e* installed fixedly on the cam shaft 31, an exhaust rocker shaft 36 (second rocker shaft), rocker arms 37 and 38 (omitted from FIG. 1) rotatably supported on the rocker shaft 36 so that they may be rocked by the cams 31*d* and 31*e*.

Further, the intake valve driving system of the valve system 30 is provided with a variable valve system 40 including a connection switching mechanism 41.

Specifically, the rocker arms (first rocker arms) 33 and 34, among the rocker arms 33 to 35 of the intake valve driving system, have adjusting screws 33*a* and 34*a*, respectively, provided at an end thereof and abuts against respective stem ends of the intake valves 11 and 12. The intake valve 11 is opened and closed in response to the rocking movement of the rocker arm 33, and the intake valve 12 is opened and closed in response to the rocking movement of the rocker arm 34.

Figure 7A:
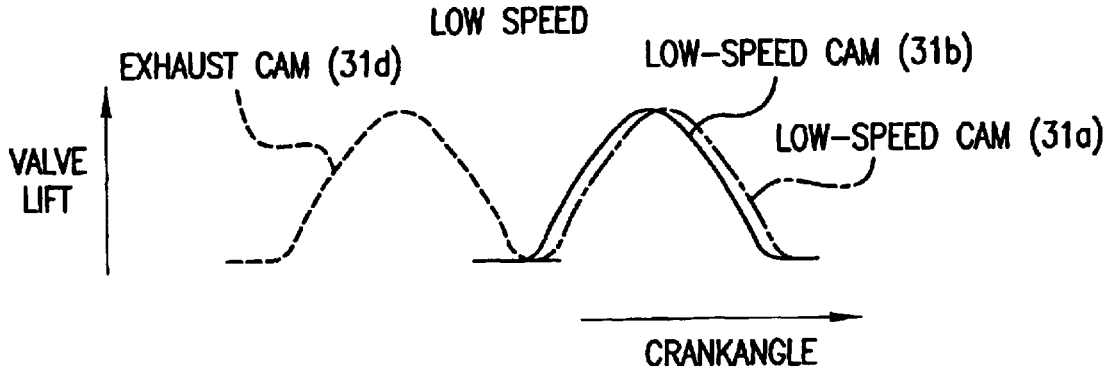
FIG. 7A shows the characteristics at a low speed and FIG. 7B shows the characteristics at a high speed.

The rocker arm 33 has a roller 33*b*, provided at the other end thereof, that abuts the low-speed cam (first cam) 31*a* having a low-speed cam profile suitable for the low-speed rotation of the engine. When the rocker arm 33 rocks in response to the movement of the low-speed cam 31*a*, the intake valve 11 is opened with such characteristics as indicated by an alternate long and short dashes line in FIG. 7A. The rocker arm 34 has a roller 34*b*, provided at the other end thereof, that abuts the low-speed cam (first cam) 31*b* having a low-speed cam profile suitable for the low-speed rotation of the engine. When the rocker arm 34 rocks in response to the movement of the low-speed cam 31*b*, the intake valve 11 is opened with such characteristics as indicated by a solid line in FIG. 7A. Incidentally, although in FIG. 7A, the valve lift phases of the two low-speed cams 31*a* and 31*b* are different, this is only an example. The valve lift phases of the two low-speed cams 31*a* and 31*b* may be identical.

On the other hand, the rocker arm (second rocker arm) 35 has an engagement projection 35*a* formed at one end thereof and is capable of being engaged with the rocker arms 33 and 34. The rocker arm 35 has a roller 35*b* provided at the other end thereof and abuts the high-speed cam (second cam) 31*c* having a high-speed cam profile suitable for the high-speed rotation of the engine.

As shown in FIG. 6, cylinders 33*d* and 34*d*, provided with respective openings 33*c*, 34*c*, are formed in a part of the rocker arms 33 and 34 against which one end of the rocker arm 35 abut. The cylinders 33*d* and 34*d* have pistons 33*e* and 34*e* incorporated therein.

Pressurized oil (in the present embodiment, lubricating oil is used as pressurized oil) is supplied into the cylinders 33*d* and 34*d* via oil passages 32*a* and 32*b* from the rocker shaft 32. When the oil pressure inside the cylinders 33*d* and 34*d* is increased, the pistons 33*e* and 34*e* are driven by the pressure of the pressurized oil received at one end of each piston 33*e*, 34*e* to project to such positions as to close the openings 33*c* and 34*c* as shown in FIG. 6B.

Figure 6A:
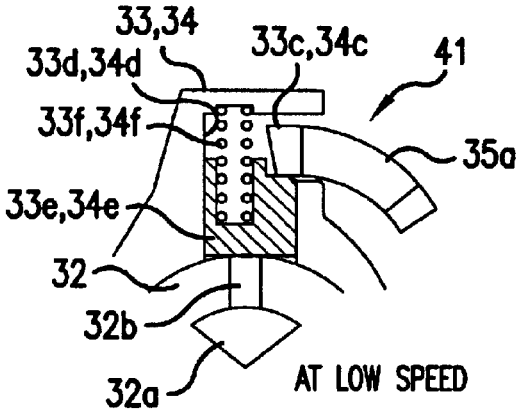
FIG. 6A shows a disconnected state and FIG. 6B shows a connected state.
Figure 6B:
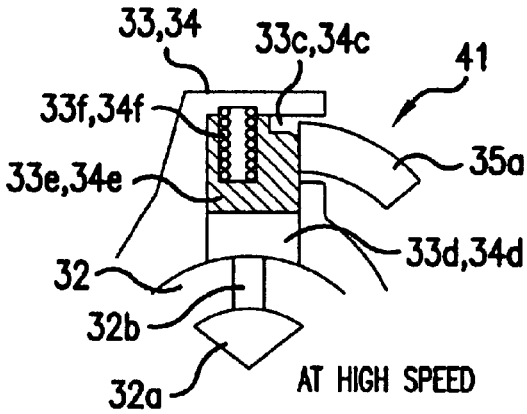

On the other hand, when the oil pressure inside the cylinders 33*d* and 34*d* is decreased, return springs 33*f* and 34*f* force the pistons 33*e* and 34*e* to recede to positions out of the openings 33*c* and 34*c* as shown in FIG. 6A.

The pistons 33*e* and 34*e* in the cylinders 33*d* and 34*d* and an oil pressure control unit 42 (see FIG. 8) that controls the internal oil pressure of the cylinders 33*d* and 34*d* constitute the connection switching mechanism 41 that connects or disconnects the rocker arms 33 and 34 to and from the rocker arm 35. The connection switching mechanism 41 and the intake valve driving system constitute the variable valve system 40.

Figure 8:
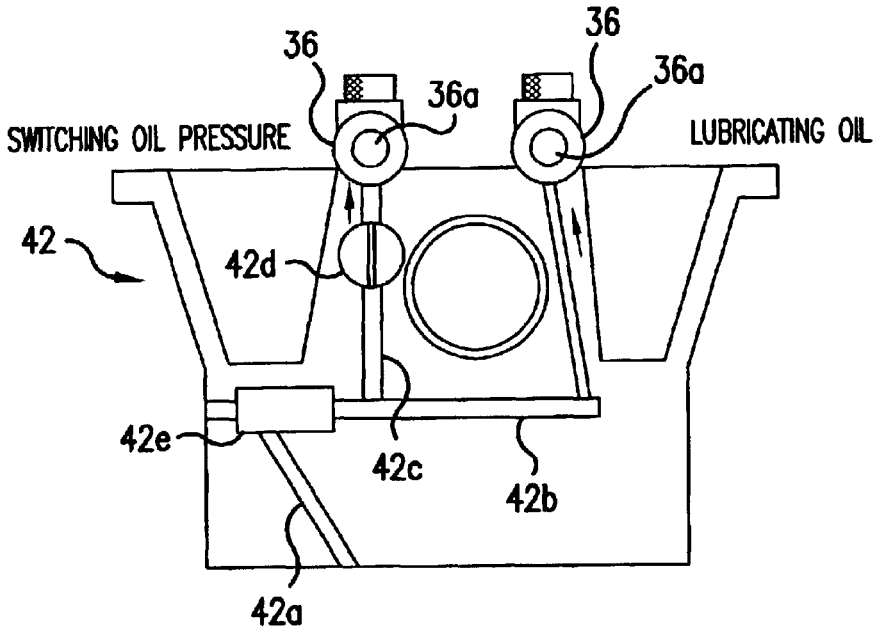
FIG. 8 is a sectional view schematically showing an oil pressure control mechanism of the connection switching mechanism in the valve system for the internal combustion engine.
Figure 9:
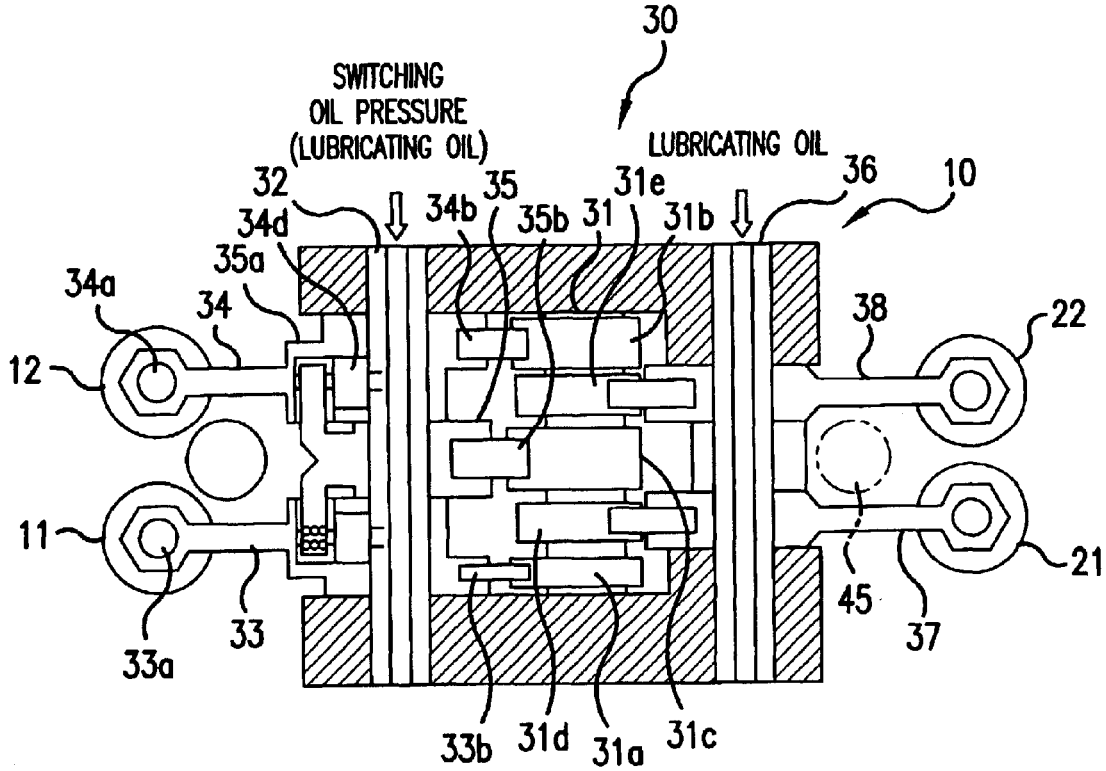
FIG. 9 is a sectional development (sectional view taken along the arrow IX—IX of FIG. 10) schematically showing the inside of the cylinder head in the valve system for the internal combustion engine.

It should be noted that, as shown in FIG. 8, the oil pressure control unit 42 is comprised of lubricating oil supply passages 42*a* to 42*c*, through which lubricating oil pumped from an oil pan (not shown) provided in the lower part of the engine to a cylinder block 10 for supplying oil to the oil passage 32*a* in the rocker shaft 32; an oil control valve 42*d* placed in the lubricating oil supply passage 42*c*; and a controller, not shown, that controls the opening amount of the oil control valve 42*d*.

FIG. 8 also shows a state in which a small-diameter oil passage of the oil control valve 42*d* for supplying lubricating oil is in communication with the lubricating oil supply passage 42*c*. When oil pressure should be applied to the pistons 33*e* and 34*e*, the oil control valve 42*d* is driven such that its large-diameter passage is brought into communication with the lubricating oil supply passage 42*c*. A filter 42*e* is disposed in the lubricating oil supply passages 42*a* and 42*b* such that the lubricating oil can be filtered and then supplied into the cylinders 33*d* and 34*d*.

With the above arrangement, when the oil pressure control unit 42 decreases the oil pressure inside the cylinders 33*d* and 34*d*, the pistons 33*e* and 34*e* are receded (refer to FIG. 6A) to form spaces in the openings 33*c* and 34*e* of the cylinders 33*d*, 34*d*. Therefore, the engagement projection 35*a* formed at one end of the rocker arm 35 enters the spaces of the openings 33*c* and 34*c*, but is never brought into contact with the rocker arms 33 and 34. As a result, the rocker arms 33 and 34 rock in response to the movement of the respective corresponding cams 31*a* and 31*b* to open and close the intake vales 11 and 12.

Figure 7B:
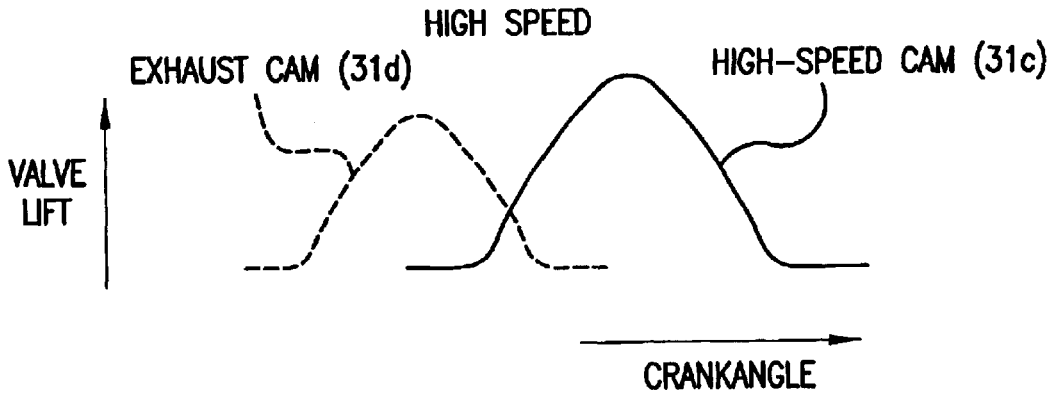

On the other hand, when the oil pressure control unit 42 increases the oil pressure inside the cylinders 33*d* and 34*d*, the pistons 33*e* and 34*e* are projected (refer to FIG. 6B) into the openings 33*c* and 34*e* of the cylinders 33*d* and 34*d*. When the rocker arm 35 is rocking, the engagement projection 35*a* formed at one end of the rocker arm 35 abuts the pistons 33*e* and 34*e* to cause the rocker arms 33 and 34 to rock via the pistons 33*e* and 34*e*. On this occasion, the rocker arms 33 and 34 are driven by the rocker arm 35 to rock in response to the movement of the high-speed cam 31*c* while getting away from the respective corresponding cams 31*a* and 31*b*. The intake valves 11 and 12 are then opened with such characteristics as indicated by a solid line in FIG. 7B in a manner suitable for the high-speed rotation of the engine.

Thus, the oil pressure control unit 42 functions as a piston position switching device that switches the positions of the pistons 33*e* and 34*e* between an engagement position where the engagement projection 35*a* is engaged with the pistons 33*e* and 34*e* and a disengagement position where the engagement projection 35*a* is not engaged with the pistons 33*e* and 34*e*.

The rocker arms (first rocker arms) 33 and 34 are forced by return springs, not shown, respectively provided in the intake valves 11 and 12 such that the rocker arms 33 and 34 can be prevented from getting away from the respective corresponding cams 31*a* and 31*b*, whereas the rocker arm (second rocker arm) 35 is not forced by any return spring. For this reason, as shown in FIG. 1, the arm spring 43, serving as the forcing member that prevents the rocker arm 35 from getting away from the cam 31*c*, is provided.

It should be noted that the arm spring 43 is comprised of a spring main body 43*a* and a casing 43*b* having the spring main body 43*a* incorporated therein, so that the force of the spring main body 43*a* can be transmitted to the rocker arm 35 via the casing 43*b*.

The arm spring 43 is mounted in a concave 144*a* formed at one end of a holder 144, and is supported by the holder 144. The holder 144 has a shaft hole 144*b*, which is formed at the intermediate part thereof and into which the rocker shaft (support shaft) 36 rotatably supporting the exhaust rocker arms (third rocker arms) 37 and 38 is inserted. The holder 144 has the other end 144*c* thereof abutting a rib (support) 145 which is installed on the cylinder head 10 in a standing condition.

Specifically, since the holder 144 is rotatably supported on the rocker shaft 36, the holder 144 is rotated when supporting the arm spring 43. To solve this problem, a locking structure 146, capable of inhibiting the holder 144 from rotating about the rocker shaft 36, is provided. The locking structure 146 comprises the rib 145 and the other end (abutment part) 144*c* abutting the rib 145 such that the locking structure 146 can restrict the rotation of the holder 144 in such a way as to support the arm spring 43.

Figure 3:
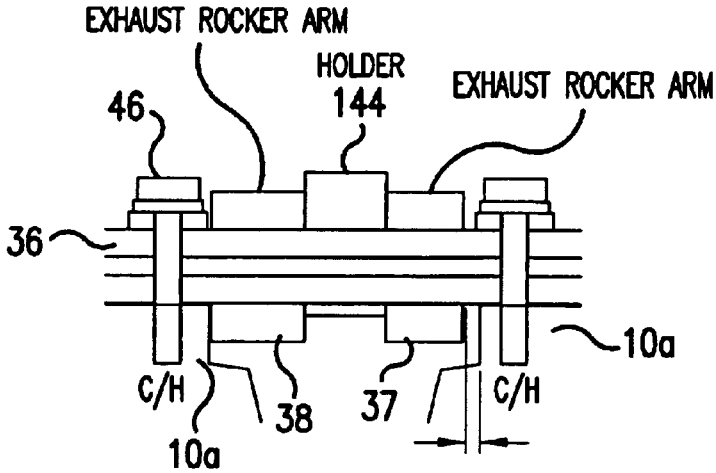
FIG. 3 is a sectional view schematically showing a rocker shaft part of the valve system for the internal combustion engine according to the first embodiment.

It should be noted that, as shown in FIG. 3, the holder 144 is mounted on the rocker shaft 36 such that it is located adjacent to the exhaust rocker arms (third rocker arms) 37 and 38, that is, between the two exhaust rocker arms 37 and 38. Of course, a clearance is formed between supporting sections 10*a* of the cylinder 10, which support the rocker shaft 36 via fastening bolts 46, and the exhaust rocker arms 37 and 38 arranged adjacent to the supporting sections 10*a* such that the exhaust rocker arms 37 and 38 can move smoothly.

Since the valve system for the internal combustion engine, according to the first embodiment of the present invention, is constructed as described above, when the oil pressure control unit (piston position switching unit) 42 increases the oil pressure inside the cylinders 33*d* and 34*d*, the pistons 33*e* and 34*e* project into the openings 33*c*, 34*e* of the cylinders 33*d* and 34*d* (refer FIG. 6B). When the rocker arm 35 is rocking, the engagement projection 35*a* formed at one end of the rocker arm 35 abuts the pistons 33*e* and 34*e* to rock the rocker arms 33 and 34 via the pistons 33*e* and 34*e*. Namely, the connection switching mechanism 41 is brought into a state of connecting the rocker arms 33 and 34 to the rocker arm 35, so that the intake rocker arms 33 and 34 rock integrally with the rocker arm 35 to open and close the intake vales 11, 12 according to the cam profile of the high-speed cam 31*c*.

On the other hand, when the oil pressure control unit (piston position switching unit) 42 decreases the oil pressure inside the cylinders 33*d*, 34*d*, the pistons 33*e* and 34*e* recede to form spaces in the openings 33*c* and 34*e* of the cylinders 33*d* and 34*d* (refer to FIG. 6A). When the rocker arm 35 is rocking, the engagement projection 35*a*, formed at one end of the rocker arm 35, enters the spaces in the openings 33*c* and 34*c*, but is not brought into contact with the rocker arms 33 and 34. Therefore, the connection switching mechanism 41 is brought into a state of disconnecting the rocker arms 33 and 34 from the rocker arm 35 such that the intake rocker arms 33 and 34 rock without being affected by the movement of the rocker arm 35 to open and close the intake vales 11 and 12 according to the cam profile of the low-speed cam 31*a* or 31*b*.

When the intake vales 11 and 12 are opened and closed as described above, the arm spring 43, serving as the forcing member, forces the rocker arm 35 such that the rocker arm 35 is being prevented from getting away from the high-speed cam 31*c*. Therefore, the rocker arm 35 can rock in a reliable manner according to the cam profile of the high-speed cam 31*c*.

Further, since the holder 144, as the supporting member supporting the arm spring 43, is rotatably supported on the rocker shaft 36, and the rotation of the holder 144 about the rocker shaft 36 is restricted by the locking structure 146 constructed such that the other end 144*e* of the holder 144 is abutted on the rib 145 installed on the cylinder head 10 in a standing condition, the holder 144 can be mounted without requiring a precision machining of the holder 144 or the cylinder head 10 or using any fastening bolts.

Therefore, since the holder 144 can be assembled easily, and the generation of thin parts can be avoided, it is possible to easily ensure stiffness of the holder 144 and stiffness of the structure for supporting the holder 144. Further, since the holder 144 can be mounted on the rocker shaft 36 without requiring a precision machining of the holder 144 or the cylinder head 10 or using any fastening bolts, the holder 144 can be easily assembled and the generation of thin parts in the holder 144 and the periphery thereof can be avoided. As a result, it is possible to easily ensure the stiffness of the holder 144 and the stiffness of the structure for supporting the holder 144.

A description will now be given of a second embodiment of the present invention.

Figure 4:
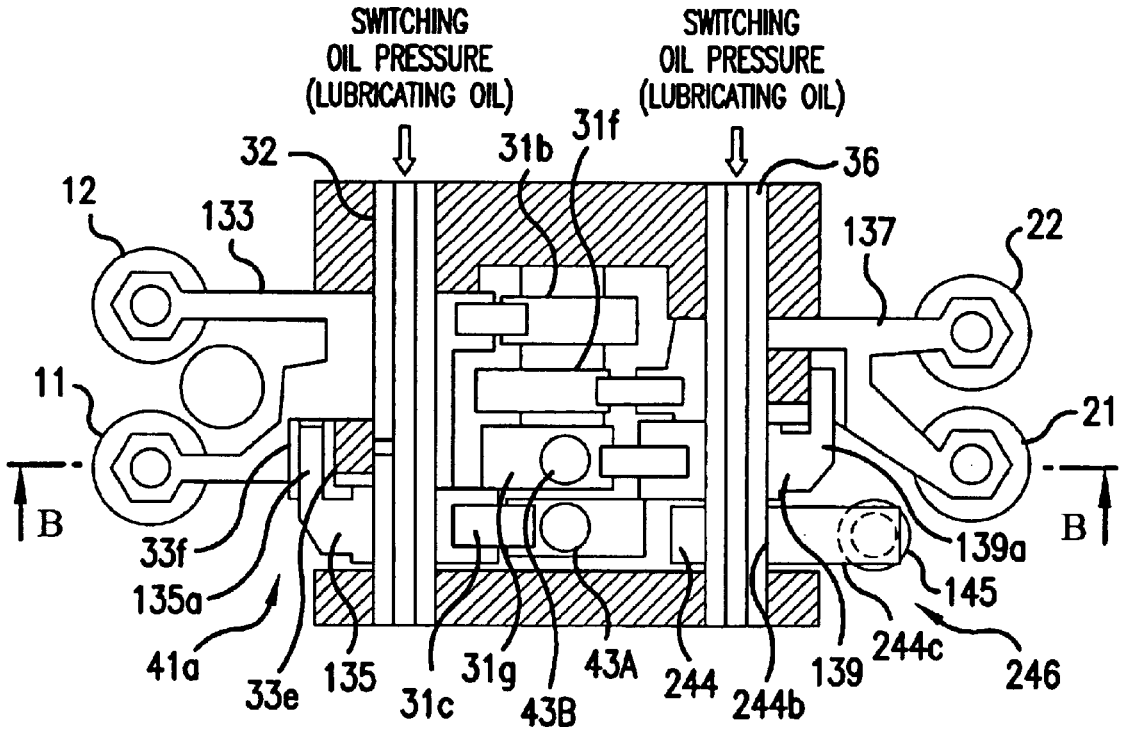
FIG. 4 is a sectional view (corresponding to FIG. 2) schematically showing the inside of a cylinder head in a valve system for an internal combustion engine according to a second embodiment of the present invention.

FIG. 4 is a sectional view (corresponding to FIG. 2) schematically showing a valve system for an internal combustion engine according to the second embodiment. In FIG. 4, elements and parts corresponding to those of FIGS. 1 to 3 are denoted by the same reference numerals.

In the present embodiment, both the intake valve driving system and the exhaust valve driving system are configured as variable valve trains.

Specifically, a rocker arm (first rocker arm) 133 rocked by the low-speed cam 31*b* and a rocker arm (second rocker arm) 135 rocked by the high-speed cam 31*c* are rotatably supported on the intake rocker shaft 32 such that they may rock. A first connection switching mechanism (intake connection switching mechanism) 41*a*, constructed in the same manner as the connection switching mechanism 41 of the first embodiment, is disposed between the rocker arm 133 and the rocker arm 135.

The first connection switching mechanism 41*a* is comprised of a piston in a cylinder, not shown, and an oil pressure control unit (constructed in the same manner as the oil pressure control unit 42 of the first embodiment) that controls the oil pressure inside the cylinder 133*d*.

One end of the rocker arm 133 is bifurcated so as to drive the respective intake valves 11 and 12. When the first connection switching mechanism 41*a* is in a state of disconnecting the rocker arm 133 from the rocker arm 135, the rocker arm 133 rocks according to the cam profile of the low-speed cam 31*b* without being affected by the movement of the rocker arm 135 to open and close the intake vales 11 and 12 in a manner suitable for the low-speed rotation of the engine as indicated by the solid line in FIG. 7A. When the first connection switching mechanism 41*a* is in a state of connecting the rocker arm 133 to the rocker arm 135, the rocker arm 133 rocks integrally with the rocker arm 135 according to the cam profile of the high-speed cam 31*c* via an engagement projection 135*a* of the rocker arm 135 to open and close the intake valves 11 and 12 in a manner suitable for the high-speed rotation of the engine as indicated by the solid line in FIG. 7B.

On the other hand, a rocker arm (third rocker arm) 137 rocked by a low-speed cam (third cam) 31*f* and a rocker arm (fourth rocker arm) 139 rocked by a high-speed cam (fourth cam) 31*g* are rotatably supported on the exhaust rocker shaft 36 such that the rocker arms 137 and 139 may rock. A second connection switching mechanism (exhaust connection switching unit) 41*b* constructed in the same manner as the connection switching mechanism 41 of the first embodiment is disposed between the rocker arm 137 and the rocker arm 139.

The second connection switching mechanism 41*b* is comprised of a piston 137*e* provided in a cylinder 137*d*, not shown, and an oil pressure control unit 42*b* (constructed in the same manner as the oil pressure control unit 42 of the first embodiment) that controls the internal oil pressure of the cylinder 137*d*.

One end of the rocker arm 137 is bifurcated so as to drive the respective exhaust valves 21 and 22. When the second connection switching mechanism 41*b* is in a state of disconnecting the rocker arm 137 from the rocker arm 139, the rocker arm 137 rocks according to the cam profile of the low-speed cam 31*f* without being affected by the movement of the rocker arm 139 to open and close the exhaust vales 21 and 22 in a manner suitable for the low-speed rotation of the engine. When the second connection switching mechanism 41*b* is in a state of connecting the rocker arm 137 to the rocker arm 139, the rocker arm 137 rocks integrally with the rocker arm 139 according to the cam profile of the high-speed cam 31*g* via an engagement projection 135*a* of the rocker arm 135 to open and close the exhaust valves 21 and 22 in a manner suitable for the high-speed rotation of the engine.

Further, as shown in FIG. 4, the rocker arm (second rocker arm) 135 and the rocker arm (fourth rocker arm) 139 are provided with respective arm springs 43A and 43B as first and second forcing members (intake and exhaust forcing members) which prevent the rocker arms 135 and 139 from getting away from the respective corresponding cams 31*c* and 31*g*.

It should be noted that as in the above described first embodiment, the arm springs 43A and 43B are each comprised of the spring main body 43*a* and the casing 43*b* having the spring main body 43*a* incorporated therein, as shown in FIG. 1, so that the force of spring main body 43*a* can be transmitted to the rocker arm 135 via the casing 43*b*.

The arm springs 43A and 43B are mounted in a concave formed at one end of a holder 244 as in the first embodiment (refer to the holder 144 in FIG. 1), and are supported by the holder 244. As in the first embodiment, the holder 244 has the shaft hole 144*b*, which is formed in the intermediate part thereof and into which the rocker shaft (support shaft) 36 supporting the exhaust rocker arms (third rocker arms) 37 and 38 is inserted, and is rotatably supported on the rocker shaft 36. The holder 244 has the other end 244*c* thereof abutting the rib (support) 145 installed on the cylinder head 10 in a standing condition.

Specifically, the rib 145 and the other end (abutment part) 144*c* abutting the rib 145 constitute a locking structure 246 capable of inhibiting the holder 244 from rotating about the rocker shaft 36, and the locking structure 246 restricts the rotation of the holder 244 in such a way as to support the arm springs 43A and 43B.

It should be noted that, as shown in FIG. 4, the holder 244 is disposed adjacent to the exhaust rocker arm (third rocker arm) 137. Of course, a clearance is formed between a supporting section of the cylinder 10, which supports the rocker shaft 36, and the exhaust rocker arms 137 and the holder 244 arranged adjacent to the supporting part so that the exhaust rocker arm 137 and the like can move smoothly.

Since the valve system for the internal combustion engine according to the second embodiment is constructed as described above, the arm springs 43A and 43B of the high-speed rocker arms 135 and 139 in the intake valve driving system and the exhaust valve driving system, respectively, are supported by one holder 244 in an efficient manner. Further, since the holder 244 is rotatably supported on the rocker shaft 36, and the rotation of the holder 244 about the rocker shaft 36 is restricted by the locking structure 246 constructed such that the other end 244*c* of the holder 244 abuts the rib 145 installed on the cylinder head 10 in a standing condition, the holder 244 can be mounted without requiring a precision machining of the holder 244 or the cylinder head 10 or using any fastening bolts.

Therefore, as is the case with the first embodiment, since the holder 244 can be assembled easily and use of thin parts can be avoided, it is possible to easily ensure stiffness of the holder 244 and the stiffness of the structure for supporting the holder 244. Further, since the holder 244 can be mounted on the rocker shaft 36 without requiring a precision machining of the holder 244 or the cylinder head 10 or using any fastening bolts, the holder 244 can be easily assembled and the use of thin parts in the holder 244 and the periphery thereof can be avoided. As a result, it is possible to easily ensure stiffness of the holder 244 and the stiffness of the structure for supporting the holder 244.

A description will now be given of a third embodiment of the present invention.

Figure 5:
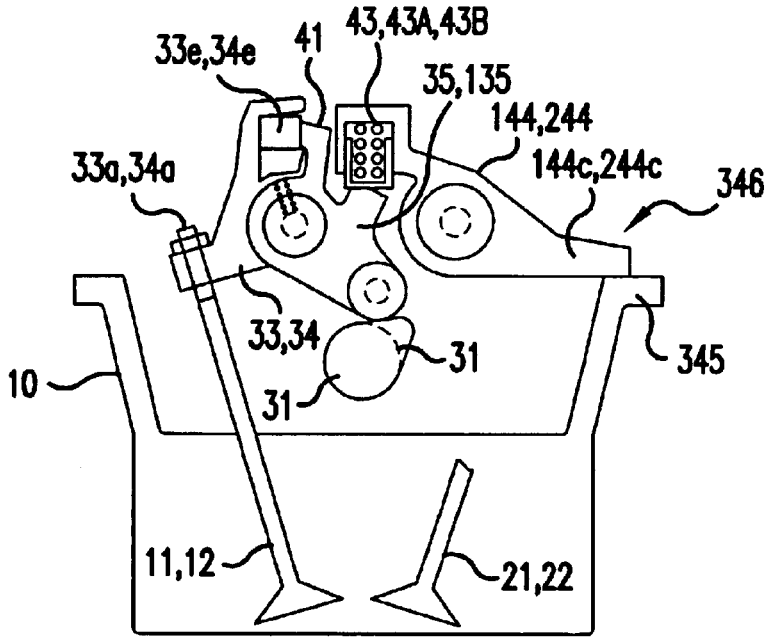
FIG. 5 is a side view schematically showing the inside of a cylinder head in a valve system for an internal combustion engine according to a third embodiment of the present invention.

FIG. 5 is a side view schematically showing the inside of a cylinder head in a valve system for an internal combustion engine according to the present embodiment. In FIG. 5, elements and parts corresponding to those of FIGS. 1 to 4 are denoted by the same reference numerals.

In the present embodiment, a locking structure 346 is constructed differently from those of the first and second embodiments. Specifically, as shown in FIG. 5, the locking structure 346, according to the present embodiment, is constructed such that the other end 144*c*, 244*c* of the holder 144, 244 abut a locking part 345 extending from an end edge of the cylinder 10.

Since the valve system for the internal combustion engine according to the third embodiment is constructed as described above, the locking structure 346 restricts the rotation of the holder 144, 244 about the rocker shaft 346, and hence, the holder 144, 244 can be mounted without requiring a precision machining of the holder 144, 244 or the cylinder head 10 or using any fastening bolts.

As a result, according to the present embodiment, the same effects as those of the first and second embodiments can be obtained only by providing the locking part 345 slightly extended from the end edge of the cylinder head 10 and extending the other end (abutment part) 144*c*, 244*c* of the holder 144, 244 such that it abuts the locking part 345.

Figure 10:
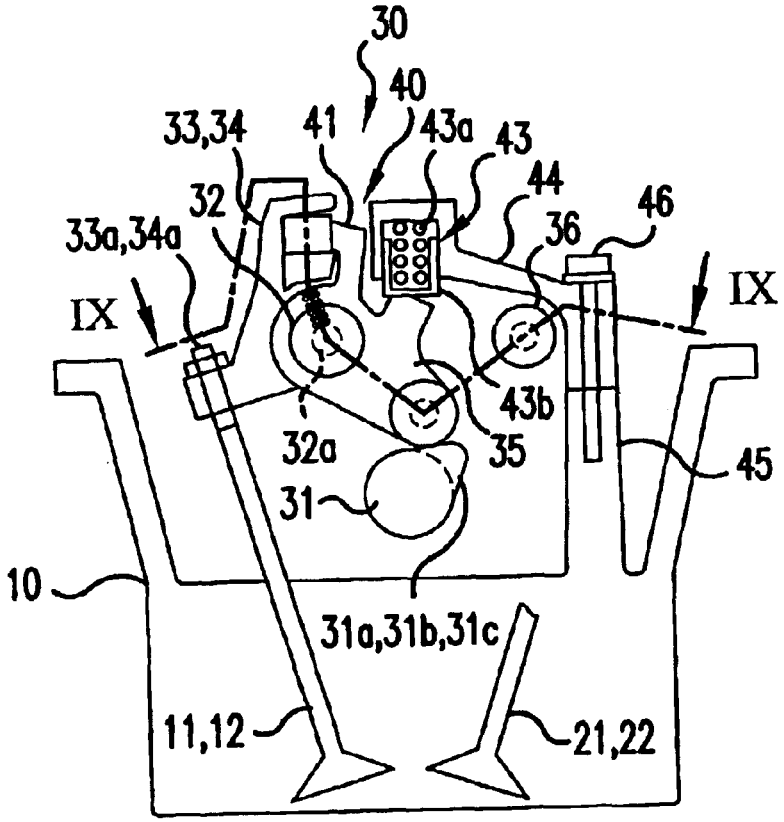
FIG. 10 is a side view schematically showing the inside of the cylinder head in the valve system for the internal combustion engine.
Figure 11:
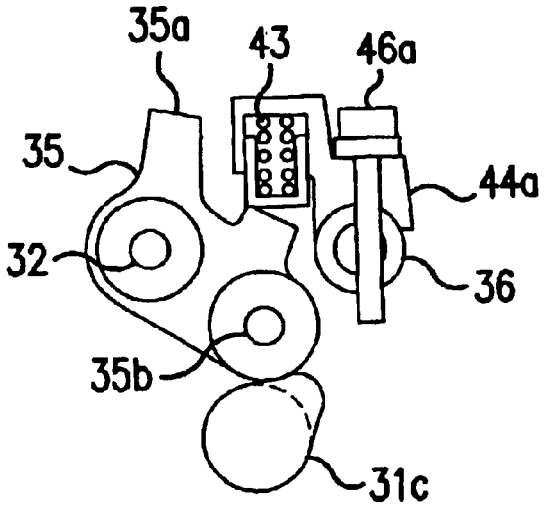
FIG. 11 is a sectional view schematically showing another supporting structure for a rocker arm forcing member in the valve system for the internal combustion engine.

A description will now be given of variations of the present invention. FIGS. 10 and 11 show a first variation of the present invention, wherein the arm spring 43 is provided as the forcing member that forces the rocker arm 35. The arm spring 43 is comprised of the spring main body 43*a* and the casing 43*b* having the arm spring 43*a* incorporated therein, so that the force of the spring main body 43*a* can be transmitted to the rocker arm 35 via the casing 43*b*. As indicated by an alternate long and two short dashes line in FIG. 10, the arm spring 43 is constructed such that a rib (support, projection) 45 is installed in a standing condition in a space formed in the upper part of the cylinder head 10 (in the periphery of the exhaust rocker shaft 36), and the holder 44 is screwed into and fastened in the support 45 by the fastening bolt 46.

FIG. 11 shows a second variation of the present invention, wherein a screw hole, into which a fastening bolt 46*a* is screwed, is pierced in the rocker shaft 36, and a holder 44*a* is directly fastened on the rocker shaft 36 by the fastening bolt 45*a*.

Although the present invention has been described in some detail by way of illustration for purposes of clarity of understanding, it will be apparent that certain changes and modifications may be practiced within the scope of the claims. Such modifications and variations, which may be apparent to a person skilled in the art, are intended to be within the scope of this invention.

For example, in the present embodiment, the holder 144 may be rotatably supported on the intake rocker shaft 32 as space permits, and in the first and second embodiments, the holder 144, 244 may be rotatably supported on another shaft member.

Further, although in the above described first and second embodiments, each of the rocker arms 33, 34, 133 driven by the low-speed cam are provided with the cylinder, piston, and opening, and each of the rocker arms 35, 135 driven by the high-speed cam are provided with the engagement projection, the present invention is not limited to this. To the contrary, the rocker arm 33, 34, 133 may be provided with an engagement projection, and the rocker arm 35, 135 may be provided with a cylinder, piston, and opening.

What is claimed is:

1. A valve system for an internal combustion engine, comprising:

a first rocker arm supported by a first rocker shaft and driven by a first cam, the first rocker arm having an end thereof connected to one of an intake valve and an exhaust valve;

a second rocker arm supported by the first rocker shaft such that said second rocker arm rocks when driven by a second cam having a different cam profile from that of the first cam, the second rocker arm being disposed adjacent to said first rocker arm;

a connection switching mechanism that switches a state of said first rocker arm between a state of being connected to said second rocker arm and a state of being disconnected from said second rocker arm;

a forcing member that forces said second rocker arm toward the second cam while said second rocker arm is rocking in such a manner as to follow a rotating movement of the second cam;

a supporting member rotatably supported on a support shaft provided in vicinity of a cylinder head to support said forcing member; and a locking structure that inhibits said supporting member from rotating about the support shaft.

2. A valve system for an internal combustion engine according to claim 1, wherein said connection switching mechanism includes, a cylinder formed in one of said first and second rocker arms, a piston slidably mounted in said cylinder, an engagement projection projecting from the other one of said first and second rocker arms and selectively engaging with an engagement part formed in said piston, and a piston position switching device that switches a position of said piston between an engagement position where said engagement projection is engaged with said piston and a disengagement position where said engagement projection is not engaged with said piston.

3. A valve system for an internal combustion engine according to claim 2, further comprising:

a third rocker arm that has one end thereof connected to the other one of the intake valve and the exhaust valve, the third rocker arm being supported on a second rocker shaft disposed in parallel with the first rocker shaft such that said third rocker arm rocks when driven by a third cam, wherein said supporting member is rotatably supported by one of the first and second rocker shafts.

4. A valve system for an internal combustion engine, comprising:

a first rocker arm supported by a first rocker shaft such that the first rocker arm rocks when driven by a first cam. The first rocker arm having an end thereof connected to one of an intake valve and an exhaust valve;

a second rocker arm supported by the first rocker shaft such that said second rocker arm rocks when driven by a second cam having a different cam profile from that of the first cam, the second rocker arm being disposed adjacent to said first rocker arm;

a first connection switching mechanism that switches a state of said first rocker arm between a state of being connected to said second rocker arm and a state of being disconnected from said second rocker arm;

a first forcing member that forces said second rocker arm toward the second cam while said second rocker arm is rocking in such a manner as to follow a rotating movement of the second cam;

a third rocker arm that has one end thereof connected to the other one of the intake valve and the exhaust valve and supported on a second rocker shaft disposed in parallel with the first rocker shaft such that said third rocker arm rocks;

a fourth rocker arm supported by the second rocker shaft such that said fourth rocker arm rocks when driven by a fourth cam having a different cam profile from that of the third cam, the fourth rocker arm being disposed adjacent to said third rocker arm;

a second connection switching mechanism that switches a state of said third rocker arm between a state of being connected to said fourth rocker arm and a state of being disconnected from said fourth rocker arm;

a second forcing member that forces said fourth rocker arm toward the fourth cam while said fourth rocker arm is rocking in such a manner as to follow a rotating movement of the fourth cam;

a supporting member rotatably supported by a support shaft provided in a cylinder head to support said first and second forcing members; and a locking structure that inhibits said supporting member from rotating about the support shaft.

5. A valve system for an internal combustion engine according to claim 4, wherein said connection switching mechanism includes, a cylinder formed in one of said first and second rocker arms and one of said third and fourth rocker arms, a piston slidably mounted in said cylinder, an engagement projection projecting from the other one of said first and second rocker arms and the other one of said third and fourth rocker arms and selectively engaging with an engagement part formed in said piston, and a piston position switching device that switches a position of said piston between an engagement position where said engagement projection is engaged with said piston and a disengagement position where said engagement projection is not engaged with said piston.

6. A valve system for an internal combustion engine according to claim 4, wherein said supporting member is rotatably supported by one of said first and second rocker shafts.

7. A valve system for an internal combustion engine according to claim 1, wherein said locking structure includes a projection installed on the cylinder head in a standing condition and an abutment part, provided in said supporting member, that abuts against said projection to inhibit said supporting member from rotating about the support shaft.

8. A valve system for an internal combustion engine according to claim 1, wherein said locking structure includes a locking part extending from an end edge of the cylinder head, and an abutment part, provided in said supporting member, that abuts against said locking part to inhibit said supporting member from rotating about the support shaft.

9. A valve system for an internal combustion engine, comprising:

a first rocker arm supported by a first rocker shaft such that the first rocker arm rocks when driven by a first cam, the first rocker arm having an end thereof connected to one of an intake valve and an exhaust valve;

a second rocker arm supported by the first rocker shaft such that said second rocker arm rocks when driven by a second cam having different cam profile from the first cam, the second rocker arm being disposed adjacent to said first rocker arm;

a connection switching mechanism that switches a state of said first rocker arm between a state of being connected to said second rocker arm and a state of being disconnected from said second rocker arm;

a forcing member that forces said second rocker arm toward the second cam while said second rocker arm is rocking in such a manner as to follow a rotating movement of the second cam;

a supporting member rotatably mounted on a cylinder head to support said forcing member; and a locking structure that prevents rotation of said supporting member by engaging with the supporting member and allows rotation in a second direction opposite to the first direction by disengaging from the supporting member.

10. A valve system for an internal combustion engine according to claim 9, wherein said supporting member is fixed to a rib installed on the cylinder head in a standing condition.

11. A valve system for an internal combustion engine according to claim 9, further comprising:

a third rocker arm that has one end thereof connected to the other one of the intake valve and the exhaust valve, the third rocker arm being supported by a second rocker shaft disposed in parallel with the first rocker shaft such that said third rocker arm rocks when driven by a third cam, wherein said supporting member is rotatably supported by one of the first and second rocker shafts.

* * * * *